US011338605B2

(12) United States Patent
Wakimoto et al.

(10) Patent No.: US 11,338,605 B2
(45) Date of Patent: May 24, 2022

(54) PAPER SHEET PROCESSING APPARATUS

(71) Applicant: Horizon International Inc., Takashima (JP)

(72) Inventors: Shigeru Wakimoto, Takashima (JP); Kohei Okamoto, Takashima (JP); Hiroto Otani, Takashima (JP)

(73) Assignee: Horizon International Inc., Shiga (JP)

( * ) Notice: Subject to any disclaimer, the term of this patent is extended or adjusted under 35 U.S.C. 154(b) by 86 days.

(21) Appl. No.: 16/939,137

(22) Filed: Jul. 27, 2020

(65) Prior Publication Data

US 2021/0039415 A1 Feb. 11, 2021

(30) Foreign Application Priority Data

Aug. 7, 2019 (JP) ..... JP2019-145541

(51) Int. Cl.

| | |
|---|---|
| ***B42B 4/00*** | (2006.01) |
| ***B42C 19/02*** | (2006.01) |
| ***B65H 45/14*** | (2006.01) |
| ***B65H 45/18*** | (2006.01) |
| ***B65H 45/22*** | (2006.01) |

(52) U.S. Cl.

CPC ..... *B42B 4/00* (2013.01); *B42C 19/02* (2013.01); *B65H 45/142* (2013.01); *B65H 45/18* (2013.01); *B65H 45/22* (2013.01); *B65H 2404/2614* (2013.01); *B65H 2511/13* (2013.01); *B65H 2511/224* (2013.01); *B65H 2801/48* (2013.01)

(58) Field of Classification Search

CPC ..... B42B 4/00; B42C 19/08; B42C 19/02; B65H 2301/4493

See application file for complete search history.

(56) References Cited

U.S. PATENT DOCUMENTS

| | | | |
|---|---|---|---|
| 3,899,165 | A | 8/1975 | Abram et al. |
| 4,168,828 | A | 9/1979 | McLear |

(Continued)

FOREIGN PATENT DOCUMENTS

| | | | |
|---|---|---|---|
| WO | 2018/025464 | A1 | 2/2018 |
| WO | 2018/207335 | A1 | 11/2018 |

OTHER PUBLICATIONS

Extended European Search Report for corresponding EP Application No. 20186915.3 dated Jan. 15, 2021.

*Primary Examiner* — Patrick H Mackey

(74) *Attorney, Agent, or Firm* — Renner, Otto, Boisselle & Sklar, LLP

(57) ABSTRACT

A paper sheet S is intermittently transported by a transport mechanism 6 and each processing unit 7, 8 operates while the transport mechanism pauses the transport operation. An information acquisition unit 9 obtains paper information from the paper sheet. A control unit 10 stores the paper information of the paper sheet to be processed for each processing unit, updates the data of the memory in a manner such that the paper information of the paper sheet associated with the previous processing unit is associated with the next processing unit every time the transport mechanism transports, and configures the settings of each processing unit for the next processing operation based on the paper information every time the processing operation of the processing unit is completed.

3 Claims, 4 Drawing Sheets

(56) References Cited

U.S. PATENT DOCUMENTS

| | | | | |
|---|---|---|---|---|
| 6,199,851 | B1 * | 3/2001 | Latvakangas | B42C 11/02 270/58.08 |
| 6,685,416 | B2 * | 2/2004 | Itoh | B65H 37/04 412/37 |
| 7,077,042 | B2 * | 7/2006 | Nogawa | B26D 7/025 83/466 |
| 7,419,149 | B2 * | 9/2008 | Oota | B65H 35/02 270/52.17 |
| 7,500,663 | B2 * | 3/2009 | Higaki | G03G 15/6544 270/32 |
| 7,658,585 | B2 * | 2/2010 | Brommer | B42C 5/02 412/22 |
| 8,070,407 | B2 * | 12/2011 | Sasamoto | G03G 15/6544 412/11 |
| 8,916,028 | B2 * | 12/2014 | Ota | D21G 9/00 162/286 |
| 10,273,109 | B2 * | 4/2019 | Oguri | B65H 35/02 |
| 2019/0152249 | A1 | 5/2019 | Fukuda | |
| 2019/0351692 | A1 | 11/2019 | Hori | |

* cited by examiner

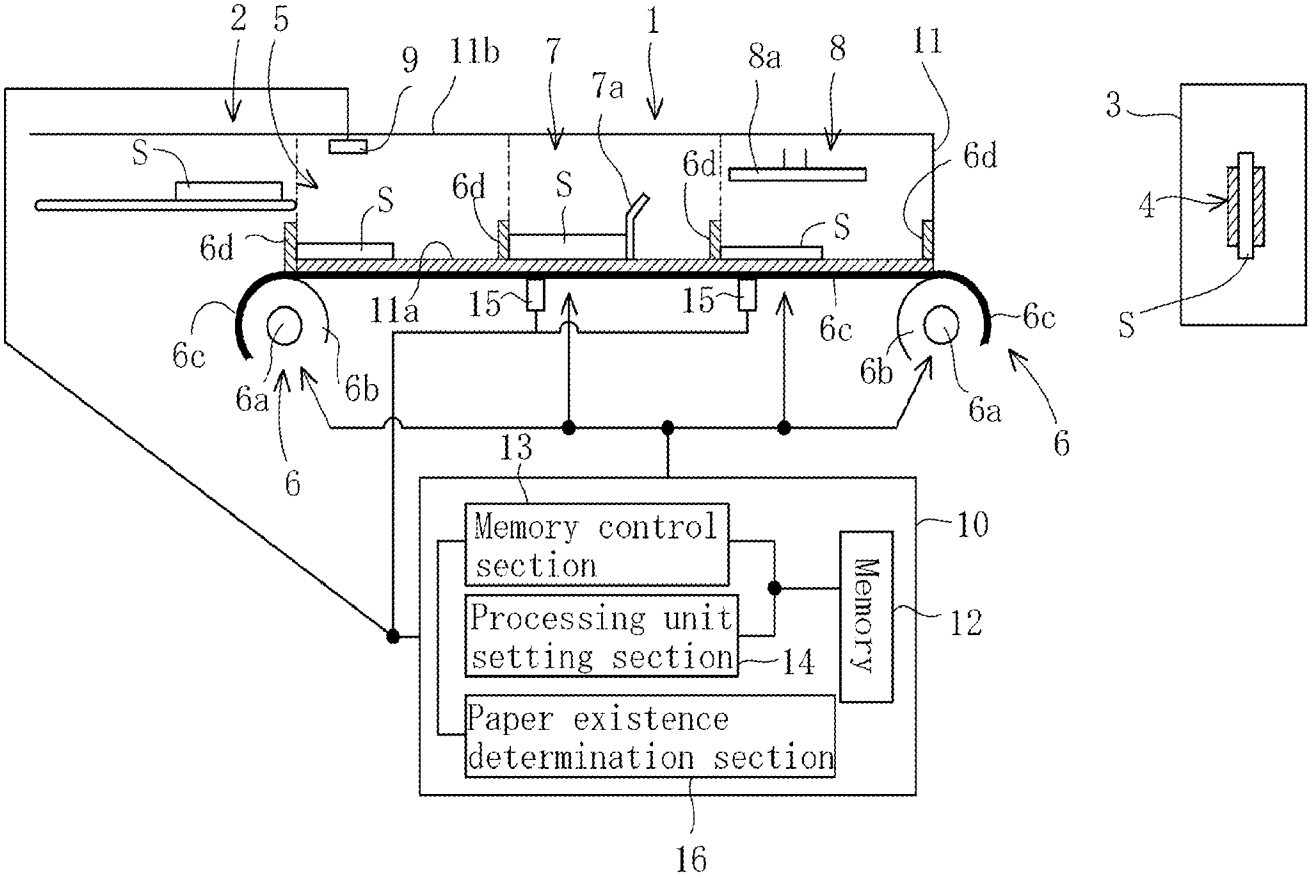
[Fig. 1]

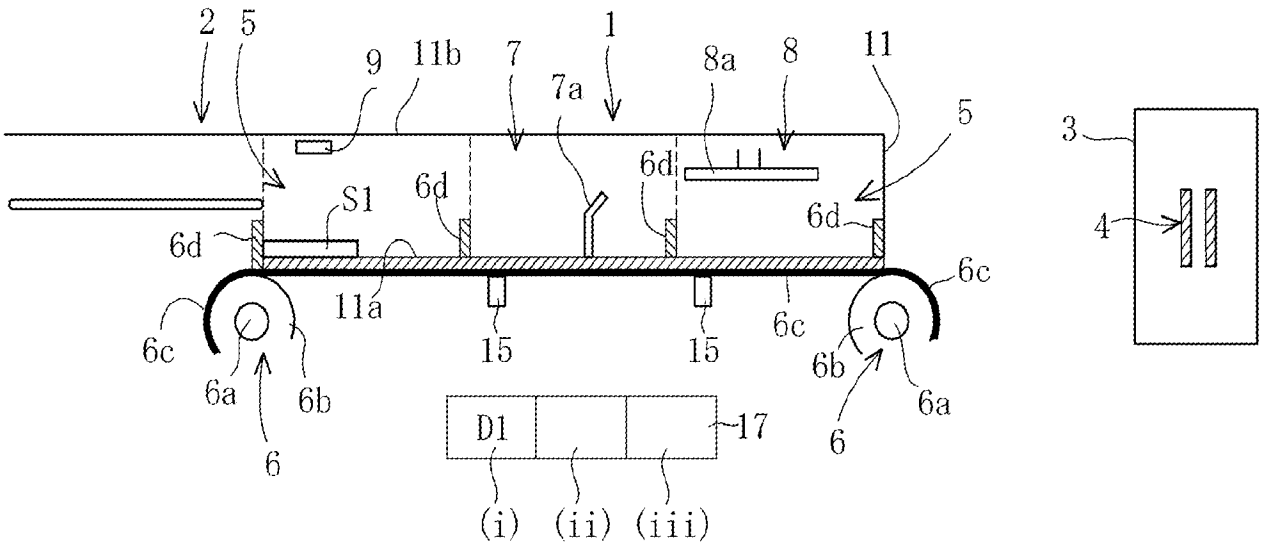
[Fig. 2A]
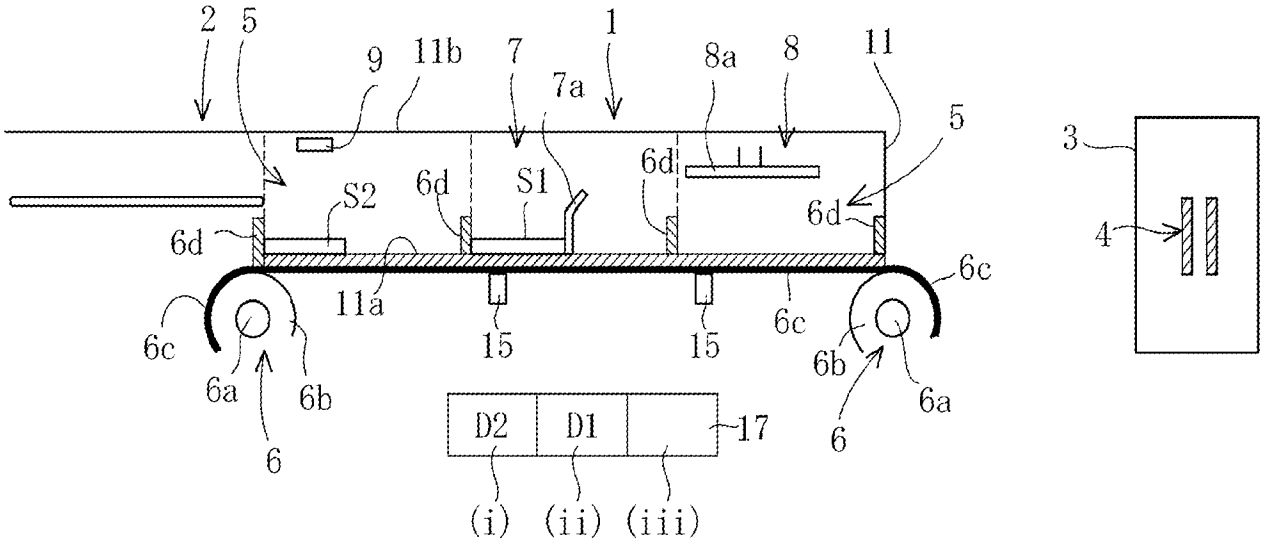
[Fig. 2B]

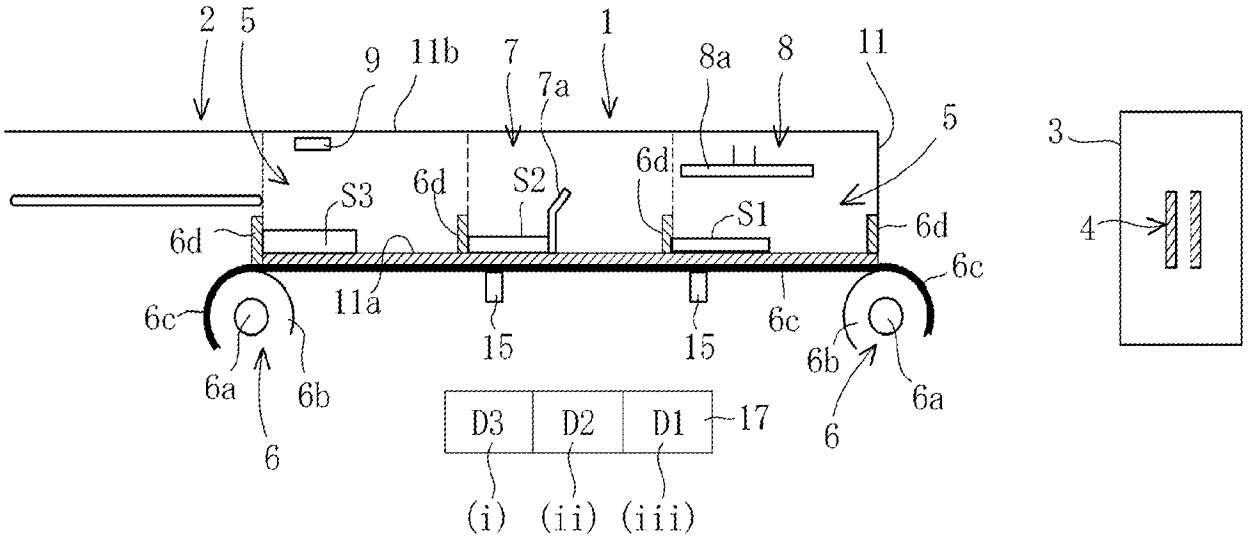
[Fig. 3A]
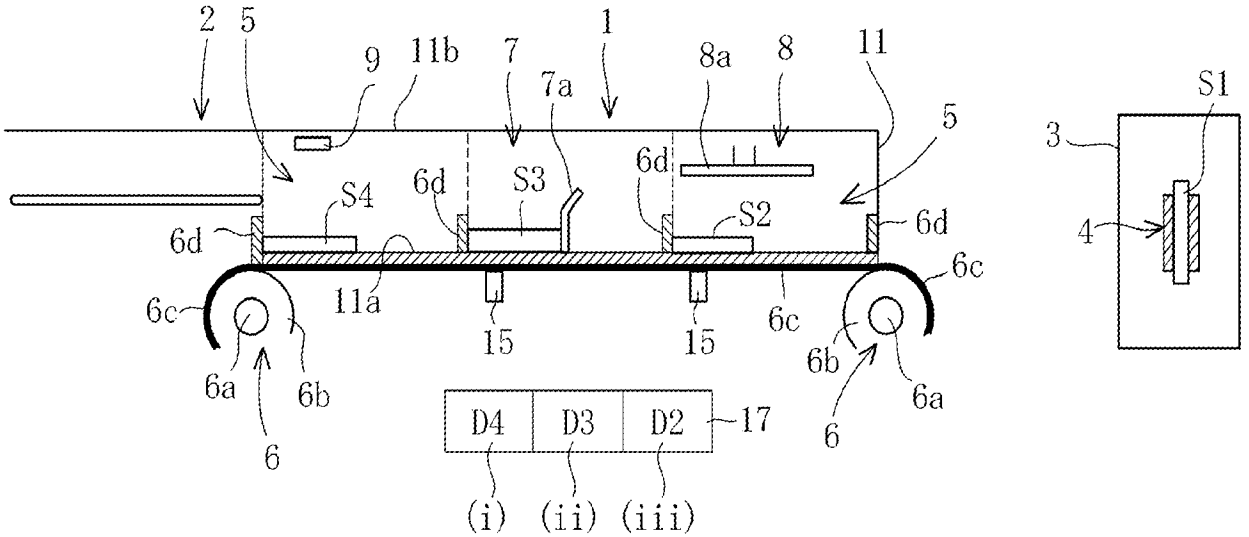
[Fig. 3B]

[Fig. 4]
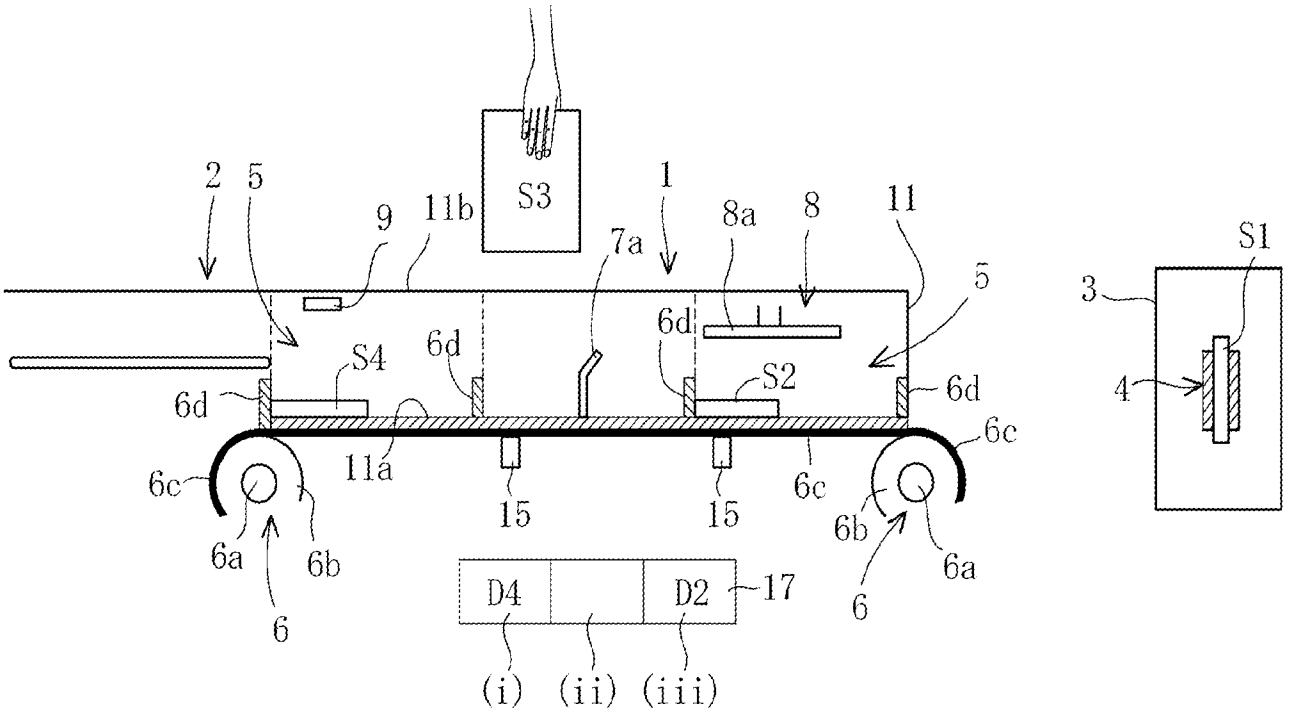

PAPER SHEET PROCESSING APPARATUS

TECHNICAL FIELD

The present invention relates to a paper sheet processing apparatus.

Here, the technical term "paper sheet" means a paper (sheet) stack, a signature, a signature stack and a book block and so on in addition to a sheet (piece) of paper. The same hereinafter.

BACKGROUND ART

As a conventional paper sheet processing apparatus, there is, for example, a saddle stitch bookbinding apparatus disclosed in WO 2018/207335 A1.

The saddle stitch bookbinding apparatus comprises a paper supplying machine supplying paper sheets one by one from a stack of sheets, a folding machine folding the paper sheet supplied from the sheet supplying machine to form a signature, a saddle stitching machine stapling and folding the signature, a connection unit arranged between the folding machine and the saddle stitching machine so as to transport the signature from the folding machine to the saddle stitching machine, and a controller controlling the paper supplying machine, the folding machine, the saddle stitching machine and the connection unit.

The folding machine comprises a buckle-type folding unit which folds the paper sheet in a direction at a right angle to the paper supply direction and a knife-type folding unit which further folds the paper sheet folded by the buckle-type folding unit in a direction at a right angle to the previous folding direction to form the signature.

The saddle stitching machine comprises a folding unit mountain folding (folding in two) the signature supplied from the folding machine along a predetermined folding line, a stitching unit arranged downstream of the folding unit so as to staple the two-folded signature at one or more predetermined positions on the folding line, and a discharging unit arranged downstream of the stitching unit to transport the stapled and two-folded signature to an exit of the saddle stitching apparatus.

The stitching unit has a transport mechanism transporting the two-folded signature in a saddle manner, a stitcher arranged at a stitching position on a transport path of the transport mechanism to staple the two-folded signature at one or more predetermined positions on the folding line, and a wire detection sensor arranged at the stitching position to detect the presence of a wire to be driven from the stitcher to the signature.

The discharging unit has a press roller pair extending across a transport path extended from the stitching unit to the exit of the saddle stitching machine, a pair of conveyor belt pairs arranged parallel with the transport path and spaced from each other in a width direction of the transport path, and a center brush arranged above the transport path and between the pair of conveyor belt pairs.

Then the stapled and two-folded signature is passed through a gap between the press roller pair, passed through a gap between the respective conveyor belt pairs while being in contact with the center brush at an upper surface thereof and transported to the exit of the saddle stitching machine.

In this saddle stitch bookbinding apparatus, before starting operation, parameters of the folding machine adjustable depending on the thickness of the paper sheet (a gap between respective roller pairs of the buckle-type folding unit and a gap between a pair of folding rollers of the knife-type folding unit) are set by the controller based on the information about the thickness of the paper sheet, and parameters of the saddle stitching machine adjustable depending on the thickness of the signature (a length of wire fed into a stitcher head 9b at every stapling of the stitcher, a height of the wire detection sensor, the gap between the press roller pair, the gap between the respective conveyor belt pairs and a height of the center brush) are set by the controller based on the information about the thickness of the signature which is calculated by the controller using the information about the thickness of the paper sheet and the information about a folding pattern of the folding machine.

Thus the paper supplying machine, the folding machine, the connection unit and the saddle stitching machine are operated in synchronization with each other by the controller, thereby the saddle stitch bookbinding apparatus is operated at the timing when the next signature is supplied from the connection unit to the saddle stitching unit when the two-folded signature is fed to the stitching unit from the folding unit of the saddle stitching machine.

As another conventional paper sheet processing apparatus, there is, for example, a non-stitch bookbinding apparatus disclosed in WO 2018/025464 A1.

The non-stitch bookbinding apparatus comprises at least one clamper movable along a transport path, a series of processing units (a milling unit, a glue application unit and a cover attachment unit) arranged along the transport path to carry out bookbinding, a cover supplying unit supplying a cover to the cover attachment unit, and a controller controlling those units and the at least one clamper, wherein a book block is bound while being gripped by the at least one clamper and passed through the series of processing units.

The clamper(s) and the processing units have parameters adjustable depending on the thickness of the book block, and before the bookbinding apparatus starts to operate, the controller calculates set values of those parameters based on the information of book block thickness and performs initial settings of the clamper(s) and the processing units according to the set values of the parameters.

Thus, in the conventional bookbinding apparatus, when the type of paper sheet to be processed is changed, paper sheets after the change are not supplied in the bookbinding apparatus until all of paper sheets before the change are processed, and after the processing of the paper sheets before the change is completed, the bookbinding apparatus is stopped.

Then the parameters of the bookbinding apparatus are reset based on the information of paper sheet after the change, thereafter the paper sheets after the change is supplied in the bookbinding apparatus and the bookbinding apparatus starts to operate.

On the other hand, in recent years, the variable bookbinding suitable for producing various kinds of bound products in small lots is becoming widespread instead of the conventional bookbinding suitable for mass-producing one type of bound product as the demand for on-demand printing grows.

However, according to the above-mentioned conventional paper sheet processing apparatus, whenever the type of paper sheet to be processed is changed, an operator must stop the paper sheet processing apparatus so as to reset parameters of the paper sheet processing apparatus based on the information of paper sheet after the change, thereby when different types of paper sheets are processed in small lots, the production efficiency may drop significantly.

SUMMARY OF THE INVENTION

Problems to be Solved by the Invention

It is, therefore, an object of the present invention to provide a paper sheet processing apparatus suitable for processing different types of paper sheets in small rots.

Means for Solving the Problems

In order to achieve this object, the present invention provides a paper sheet processing apparatus comprising: a transport mechanism intermittently transporting a paper sheet on a transport path; a plurality of processing units arranged along the transport path so as to process the paper sheet; an information acquisition unit arranged at an entrance of the transport path or upstream of a most upstream unit of the processing units so as to obtain paper information from the paper sheet; and a control unit controlling the transport mechanism and the processing units, wherein the paper sheet is transported by the transport mechanism from unit to unit between the processing units or between the information acquisition unit and a most downstream unit of the processing units, and while the transport mechanism pauses the transport operation, each of the processing units processes the associated paper sheet, wherein the control unit comprises a memory for storing the paper information of the paper sheet to be processed for each processing unit, a memory control section updating data of the memory in a manner such that the paper information of the paper sheet associated with the previous processing unit which has processed the paper sheet is associated with the next processing unit each time the transport mechanism transports, and a processing unit setting section configuring the settings of each of the processing units for the next processing operation based on the paper information of the memory each time the processing operation of each of the processing units is completed.

Here, a technical term "paper sheet" means a paper sheet stack, a signature, a signature stack and a book block and so on in addition to a sheet (piece) of paper.

According to a preferred embodiment of the present invention, the paper sheet processing apparatus further comprises at least one sensor arranged at each of the processing units so as to detect the paper sheet in the range of the associated processing unit, wherein the memory is adapted to hold the paper information even when the operation of the paper sheet processing apparatus is stopped, wherein the control unit further comprises a paper existence determination section determining based on detection signals of the sensors whether the paper sheet exists or not in the range of each of the processing units each time the transport mechanism pauses the transport operation, wherein, when the paper existence determination section determines that the paper sheet does not exist, the paper information associated with the corresponding processing unit is deleted from the memory by the memory control section.

According to another preferred embodiment of the present invention, the paper information is a thickness of the paper sheet or a vertical and horizontal size of the paper sheet or a vertical and horizontal size of a product to be made of the paper sheet or the quality of the paper sheet or the identification code on the paper sheet or a combination of two or more thereof.

According to further preferred embodiment of the present invention, the paper sheet processing apparatus is a paper stack supplying apparatus arranged between a paper stacking apparatus and a bookbinding apparatus which has at least one clamper so as to supply a paper stack received from the paper stacking apparatus to the at least one clamper, wherein the processing units are a jogger and a press unit which is arranged adjacently downstream of the jogger.

Effect of the Invention

According to the present invention, the transport mechanism is arranged for intermittently transporting the paper sheet, and the processing units are arranged along the transport path, and the information acquisition unit is arranged at the entrance of the transport path or upstream of the most upstream unit of the processing units, whereby the paper sheet is transported by the transport mechanism from unit to unit and each of the processing units operates while the transport mechanism pauses the transport operation.

Furthermore the paper information of the paper sheet to be processed for each processing unit is stored in the memory, and the data of the memory is updated in a manner such that the paper information of the paper sheet associated with the previous processing unit which has processed the paper sheet is associated with the next processing unit each time the transport mechanism transports, and the settings of each processing unit are configured for the next processing operation based on the paper information of the memory each time the processing operation of the processing unit is completed.

Thus the type of paper sheet can be changed during operation of the paper sheet processing apparatus so that an operator has no need for stopping the paper sheet processing apparatus every time the type of paper sheet is changed, and accordingly, the production efficiency greatly improves when different types of paper sheets are processed in small lots.

BRIEF DESCRIPTION OF THE DRAWINGS

FIG. 1 is a schematic diagram of a paper sheet processing apparatus according to an embodiment of the present invention.

FIGS. 2A and 2B are views similar to FIG. 1, illustrating the movement of the paper sheet processing apparatus shown in FIG. 1

FIGS. 3A and 3B are views similar to FIG. 1, illustrating the operation of the paper sheet processing apparatus shown in FIG. 1.

FIG. 4 is a view similar to FIGS. 3A and 3B, illustrating the operation of the paper sheet processing apparatus shown in FIG. 1.

BEST MODE FOR CARRYING OUT THE INVENTION

A preferred embodiment of the present invention will be explained below with reference to accompanying drawings.

FIG. 1 is a schematic diagram of a paper sheet processing apparatus according to an embodiment of the present invention.

Referring to FIG. 1, in this embodiment, a paper sheet processing apparatus 1 is a paper stack supplying apparatus arranged between a paper stacking apparatus 2 and a bookbinding apparatus 3 which has at least one clamper 4 so as to supply a paper stack S received from the paper stacking apparatus 2 to the at least one clamper 4 of the bookbinding apparatus 3.

The paper sheet processing apparatus (paper stack supplying apparatus) 1 comprises a transport mechanism 6 intermittently transporting the paper stack S, which is supplied by the paper stacking apparatus 2, along a transport path 5, a first processing unit (jogger) 7 and a second processing unit (press unit) 8 which are arranged along the transport path 5 so as to process the paper stack S, an information acquisition unit 9 arranged upstream of the first processing unit 7 on the transport path 5 so as to obtain paper information from the paper stack S, and a control unit 10 controlling the transport mechanism 6 and the first and second processing units 7, 8.

In this embodiment, a horizontal plate 11 with L-shaped cross section is attached to a frame (not shown) of the paper stack supplying apparatus 1 in a way such that an inside surface of the plate 11 opens upwardly and both a vertical wall 11*a* and a horizontal wall 11*b* of the plate 11 slope. The transport path 5 consists of the inside surface of the plate 11.

The paper stack S supplied from the paper stacking apparatus 2 is placed on the transport path 5 in such a manner that a spine of the paper stack S contacts with the sloping horizontal wall 11*b* of the plate 11 and a front or back surface of the paper stack S contacts with the sloping vertical wall 11*a* of the plate 11.

It should be noted that a portion of FIG. 1 drawing the paper stack supplying apparatus is drawn as a schematic plan view of the paper stack supplying apparatus viewed in a direction toward the sloping vertical wall 11*a* of the plate 11.

The transport mechanism 6 comprises a pair of rotary shafts 6*a*, 6*a*, a sprocket 6*b*, 6*b* mounted on each of the rotary shafts 6*a*, 6*a*, an endless chain 6*c* extended between the sprockets 6*b*, 6*b*, feed claws 6*d* attached to the endless chain 6*c* and evenly spaced along the length of the endless chain 6*c*, and a drive mechanism (not shown) rotating one of the rotary shafts 6*a*, 6*a*.

In this case, the vertical wall 11*a* of the plate 11 is provided with a slit (not shown) and the feed claws 6*d* protrude to the surface of the vertical wall (transport path 5) through the slit.

As can be seen from the drawing, the information acquisition unit 9 and the first and second processing units 7, 8 are arranged with an interval corresponding to the interval between adjacent feed claws 6*d* of the transport mechanism 6.

Thus the endless chain 6*c* is intermittently rotated by a distance corresponding to the interval between the adjacent feed claws 6*d* so that the feed claws 6*d* push a top or bottom of the associated paper stack S, thereby the paper stack S is intermittently transported from the information acquisition unit 9 to the second processing unit 8 through the first processing unit 7 so as to be transported from unit to unit.

Furthermore, while the transport mechanism 6 pauses the transport operation, each of the first and second processing units 7, 8 processes the associated paper stack S. The paper stack S processed by the second processing unit 8 is delivered form the second processing unit 8 to the clamper 3 of the bookbinding apparatus 2 by a paper stack delivery mechanism (not shown) before the transport mechanism 6 starts the next transport operation or at the same time as the next transport operation of the transport mechanism 6.

In this embodiment, the information acquisition unit 9 is a bar code or a QR code reader, and arranged opposite to the inside surface of the sloping vertical wall 11*a* of the plate 11.

On the other hand, a surface of the paper stack S facing to the information acquisition unit 9 (the front or back surface of the paper stack S) is provided with a bar code or a QR code into which the paper information of the paper stack S.

Accordingly, the paper information is obtained from the paper stack S by the information acquisition unit 9 every time the paper stack S stops in the range of the information acquisition unit 9.

In this embodiment, the paper information is a thickness of the paper stack S, and a vertical and horizontal size of the paper stack S, and the quality of paper sheets forming the paper stack S(distinction between coated and fine paper etc.), and a thickness per sheet of the paper stack S.

In this embodiment, the first processing unit (jogger) 7 performs processing operation to arrange the paper stack S.

The first processing unit 7 comprises a jogging guide 7*a* which jogs the paper stack S in a longitudinal direction (directing from top to bottom of the paper stack S) while vibrating the paper stack S, a vibration mechanism (not shown) vibrating the jogging guide 7*a*, and one or more air nozzles (not shown) blowing an air on the paper stack S so as to separate the paper sheets.

The position of the jogging guide 7*a* is adjustable depending on the vertical and horizontal size and thickness of the paper stack S, and the vibration speed of the jogging guide 7*a* is adjustable depending on the thickness of the paper stack S and the quality of paper sheets forming the paper stack S and the thickness per sheet of the paper stack S, and the air volume and pressure of the air blown from the air nozzle are adjustable depending on the vertical and horizontal size and thickness of the paper stack S, and the time and number of jogging are adjustable depending on the vertical and horizontal size and thickness of the paper stack S.

The second processing unit (press unit) 8 performs processing operation to remove excess air from the paper stack S by pressing the paper stack S so that the arrangement of the paper stack S is prevented from breaking in subsequent processing.

The second processing unit 8 comprises a stopper (not shown) for positioning the paper stack S at a press position, a press plate 8*a*, and a drive mechanism (not shown) driving the press plate 8*a*.

The position of the stopper is adjustable depending on the vertical and horizontal size of the paper stack S, and the pressing pressure and pressing time of the press plate 8*a* is adjustable depending on the thickness of the paper stack S.

The control unit 10 comprises a memory 12 for storing the paper information of the paper stack S to be processed for each processing unit 7, 8, and a memory control section 13 updating data of the memory in a manner such that the paper information of the paper stack S associated with the previous processing unit which has processed the paper sheet is associated with the next processing unit each time the transport mechanism transports 6.

The memory 12 is adapted to hold the paper information even when the operation of the paper sheet processing apparatus 1 is stopped.

The control unit 10 also comprises a processing unit setting section 14 configuring the settings of each of the first and second processing units 7, 8 for the next processing operation based on the paper information of the memory 12 each time the processing operation of each of the first and second processing units 7, 8 is completed.

Next, the operation of the paper sheet processing apparatus 1 of the present invention will be explained in more detail.

FIGS. 2A, 2B and 3A, 3B are views similar to FIG. 1, illustrating the operation of the paper sheet processing apparatus 1 shown in FIG. 1.

In FIGS. 2A, 2B and 3A, 3B, the control unit 10 shown in FIG. 1 is omitted. Furthermore, in FIGS. 2A, 2B and 3A, 3B, the numeral 17 designates a data array in the memory 12, in which the paper information obtained by the information acquisition unit 9 is stored in a start address (i), and the paper information of the paper stack S to be processed by the first processing unit 7 is stored in a second address (ii), and the paper information of the paper stack S to be processed by the second processing unit 8 is stored in the third address (iii).

As shown in FIG. 2A, while the transport mechanism 6 of the paper sheet processing apparatus 1 pauses the transport operation, the paper information D1 is obtained from a first paper stack S1 by the information acquisition unit 9 and stored in the start address (i) of the data array 17 in the memory 12 when the first paper stack S1 is supplied from the paper stacking apparatus 2 to the information acquisition unit 9.

Next, as shown in FIG. 2B, the transport mechanism 6 performs a first transport operation so as to transport the first paper stack S from the information acquisition unit 9 to the first processing unit 7, thereafter the transport mechanism stops.

At the same time as the start of the first transport operation, the paper information D1 is deleted from the start address (i) of the data array 17 and stored in the second address (ii) of the data array 17.

Furthermore, the parameters of the first processing unit 7 to be adjusted are set based on the paper information D1 stored in the data array 17 before the start of the first transport operation or during the first transport operation.

After that, the first processing unit 7 performs a first processing operation to process the first paper stack S1.

Then a second paper stack S2 is supplied from the paper stacking apparatus 2 to the information acquisition unit 9, and the paper information D2 is obtained from the second paper stack S2 by the information acquisition unit 7 and stored in the start address (i) of the data array 17.

Next, as shown in FIG. 3A, the transport mechanism 6 performs a second transport operation in a manner such that the first paper stack S1 is transported from the first processing unit 7 to the second processing unit 8 and the second paper stack S2 is transported from the information acquisition unit 7 to the first processing unit 7, thereafter the transport mechanism 6 stops.

At the same time as the start of the second transport operation, the paper information D1 is deleted from the second address (ii) of the data array 17 and stored in the third address (iii) of the data array 17, and the paper information D2 is deleted form the start address (i) of the data array 13 and stored in the second address (ii) of the data array 13.

After the first processing operation of the first processing unit 7, the parameters of each of the first and second processing units 7, 8 to be adjusted are set based on the associated paper information D1 and D2 stored in the data array 17.

While the transport mechanism 8 pauses the transport operation, the second processing unit 8 performs a first processing operation to process the first paper stack S1 and the first processing unit 7 performs a second processing operation to process the second paper stack S2.

Then a third paper stack S3 is supplied from the paper stacking apparatus 2 to the information acquisition unit 9, and the paper information D3 is obtained from the third paper stack S3 by the information acquisition unit 9 and stored in the start address (i) of the data array 17.

As shown in FIG. 3B, after the first paper stack S1 is processed by the second processing unit 8 and supplied to the clamper 3 of the bookbinding apparatus 2 by the paper stack delivery mechanism (not shown), the transport mechanism 6 performs a third transport operation in a manner such that the second paper stack S2 is transported from the first processing unit 7 to the second processing unit 8 and the third paper stack S3 is transported from the paper information acquisition unit 9 to the first processing unit 7, thereafter the transport mechanism 6 stops.

At the same time as the start of the third transport operation, the paper information D1 is deleted from the third address (iii) of the data array 17, and the paper information D2 is deleted from the second address (ii) of the data array 17 and stored in the third address (iii) of the data array 17, and the paper information D3 is deleted form the start address (i) of the data array 13 and stored in the second address (ii) of the data array 13.

When the paper information D1 deleted from the third address (iii) of the data array 17 is required by a machine which is arranged downstream of the paper sheet processing apparatus 1, the paper information D1 is transferred to a control section of the machine.

After each of the second processing operation of the first processing unit 7 and the first processing operation of the second processing unit 8 is completed, the parameters of each of the first and second processing units 7, 8 to be adjusted are set based on the associated paper information D3, D2 stored in the data array 17.

While the transport mechanism 8 pauses the transport operation, the second processing unit 8 performs a second processing operation to process the second paper stack S2 and the first processing unit 7 performs a third processing operation to process the third paper stack S3.

Then a forth paper stack S4 is supplied from the paper stacking apparatus 2 to the information acquisition unit 9, and the paper information D4 is obtained from the forth paper stack S4 by the information acquisition unit 7 and stored in the start address (i) of the data array 17.

The above operation is repeated during the operation of the paper sheet processing apparatus 1.

According to the paper sheet processing apparatus 1, the type of paper stack S can be changed during operation of the paper sheet processing apparatus 1 so that an operator has no need for stopping the paper sheet processing apparatus 1 every time the type of paper stack S is changed, and accordingly, the production efficiency greatly improves when different types of paper stack S are processed in small lots.

The paper sheet processing apparatus 1 further comprises a sensor 15 arranged at each of the first and second processing units 7, 8 so as to detect the paper stack S in the range of the associated processing unit 7, 8.

In this embodiment, the sensor 15 is a reflective optical sensor, and arranged behind the vertical wall 11*a* of the plate 11 within the associated processing unit 7, 8 and opposite to the vertical wall 11*a*.

A detection window (not shown) is formed in an area of the vertical wall 11*a* overlapped with a detection area of the sensor 15.

The control unit 10 further comprises a paper existence determination section 16 determining based on detection signals of the sensors 15 whether the paper stack S exists or not in the range of each of the first and second processing units 7, 8 each time the transport mechanism 6 pauses the transport operation.

When the paper existence determination section 16 determines that the paper stack S does not exist, the paper information associated with the corresponding processing unit 7, 8 is deleted from the memory 12 by the memory control section 13.

This will be explained specifically with reference to the drawing.

FIG. 4 is a view similar to FIGS. 3A and 3B, illustrating the operation of the paper sheet processing apparatus shown in FIG. 1, wherein the paper sheet processing apparatus stops to operate automatically due to error or the paper sheet processing apparatus 1 is stopped to operate manually by an operator so that the third paper stack S3 is removed from the first processing unit (jogger) 7 in which the problem occurred.

In this case, the paper existence determination section 16 determines that the paper stack S3 does not exist within the first processing unit (jogger) 7, the paper information D3 associated with the first processing unit 7 is deleted from the second address (ii) of the data array 17 by the memory control section 13.

On the other hand, the paper information D4 and D2 stored in the remaining addresses (first and third addresses) of the data array 17 is held.

Thus, when the paper sheet processing apparatus 1 stops to operate automatically due to error or is stopped to operate manually by an operator and the paper stack S is removed from the processing unit 7, 8 in which the problem occurred, the paper sheet processing apparatus 1 can be restarted without removal of the paper stack S which is in the range of each of the remaining processing units 7, 8, and accordingly, it is possible to prevent a decrease in production efficiency.

While a preferred embodiment of the present invention has been set forth for purposes of illustration, the foregoing description should not be deemed a limitation of the invention herein. Accordingly, various modifications, adaptations and alternatives may occur to one skilled in the art without departing from the spirit and the scope of the present invention.

For example, although, in the above-mentioned embodiment, the information acquisition unit is arranged upstream of the most upstream unit of the processing units and the paper stack is transported by the transport mechanism from unit to unit between the information acquisition unit and the most downstream unit of the processing units, the information acquisition unit may be arranged at an entrance of the transport path and the paper stack may be transported by the transport mechanism from unit to unit between the processing units.

Also, although the paper sheet processing apparatus is the paper stack supplying apparatus, a configuration of the paper sheet processing apparatus is not limited to the above-mentioned embodiment.

The paper sheet processing apparatus may have any configuration as long as the paper sheet processing apparatus comprises a transport mechanism intermittently transporting a paper sheet on a transport path; a plurality of processing units arranged along the transport path so as to process the paper sheet; an information acquisition unit arranged at an entrance of the transport path or upstream of a most upstream unit of the processing units so as to obtain paper information from the paper sheet; and a control unit controlling the transport mechanism and the processing units, wherein the paper sheet is transported by the transport mechanism from unit to unit between the processing units or between the information acquisition unit and a most downstream unit of the processing units, and while the transport mechanism pauses the transport operation, each of the processing units processes the associated paper sheet, wherein the control unit comprises a memory for storing the paper information of the paper sheet to be processed for each processing unit, a memory control section updating data of the memory in a manner such that the paper information of the paper sheet associated with the previous processing unit which has processed the paper sheet is associated with the next processing unit every time the transport mechanism transports, and a processing unit setting section configuring the settings of each of the processing units for the next processing operation based on the paper information of the memory each time the processing operation of each of the processing units is completed.

The type and number of processing units to be combined can be also set appropriately.

In addition, the paper information obtained from the paper sheet by the information acquisition unit is not limited to the above-mentioned embodiment, and the paper information may include all of the information necessary to set parameters to be adjusted with respect to paper sheet to be processed for each processing unit of the paper sheet processing apparatus.

DESCRIPTION OF REFERENCE NUMERALS

1 Paper sheet processing apparatus (Paper stack supplying apparatus)
2 Paper stacking apparatus
3 Bookbinding apparatus
4 Clamper
5 Transport path
6 Transport mechanism
6*a* Rotary shaft
6*b* Sprocket
6*c* Endless chain
6*d* Feed claw
7 First processing unit
7*a* Jogging guide
8 Second processing unit
8*a* Press plate
9 Information acquisition unit
10 Control unit
11 Plate
11*a* Vertical wall
11*b* Horizontal wall
12 Memory
13 Memory control section
14 Processing unit setting section
15 Sensor
16 Paper existence determination section
17 Data array

The invention claimed is:

1. A paper sheet processing apparatus comprising:

a transport mechanism intermittently transporting a paper sheet on a transport path;

a plurality of processing units arranged along the transport path so as to process the paper sheet;

an information acquisition unit arranged at an entrance of the transport path or upstream of a most upstream unit of the processing units so as to obtain paper information from the paper sheet; and a control unit controlling the transport mechanism and the processing units, wherein the paper sheet is transported by the transport mechanism from unit to unit between the processing units or between the information acquisition unit and a most downstream unit of the processing units, and while the transport mechanism pauses the transport operation, each of the processing units processes the associated paper sheet, wherein the control unit comprises a memory for storing the paper information of the paper sheet to be processed for each processing unit, a memory control section updating data of the memory in a manner such that the paper information of the paper sheet associated with the previous processing unit which has processed the paper sheet is associated with the next processing unit each time the transport mechanism transports, and a processing unit setting section configuring the settings of each of the processing units for the next processing operation based on the paper information of the memory each time the processing operation of each of the processing units is completed, and further comprising at least one sensor arranged at each of the processing units so as to detect the paper sheet in the range of the associated processing unit, wherein the memory is adapted to hold the paper information even when the operation of the paper sheet processing apparatus is stopped, wherein the control unit further comprises a paper existence determination section determining based on detection signals of the sensors whether the paper sheet exists or not in the range of each of the processing units each time the transport mechanism pauses the transport operation, wherein, when the paper existence determination section determines that the paper sheet does not exist, the paper information associated with the corresponding processing unit is deleted from the memory by the memory control section.

2. The paper sheet processing unit according to claim 1, wherein the paper information is a thickness of the paper sheet or a vertical and horizontal size of the paper sheet or a vertical and horizontal size of a product to be made of the paper sheet or the quality of the paper sheet or the identification code on the paper sheet or a combination of two or more thereof.

3. A paper sheet processing apparatus comprising:

a transport mechanism intermittently transporting a paper sheet on a transport path;

a plurality of processing units arranged along the transport path so as to process the paper sheet;

an information acquisition unit arranged at an entrance of the transport path or upstream of a most upstream unit of the processing units so as to obtain paper information from the paper sheet; and a control unit controlling the transport mechanism and the processing units, wherein the paper sheet is transported by the transport mechanism from unit to unit between the processing units or between the information acquisition unit and a most downstream unit of the processing units, and while the transport mechanism pauses the transport operation, each of the processing units processes the associated paper sheet, wherein the control unit comprises a memory for storing the paper information of the paper sheet to be processed for each processing unit, a memory control section updating data of the memory in a manner such that the paper information of the paper sheet associated with the previous processing unit which has processed the paper sheet is associated with the next processing unit each time the transport mechanism transports, and a processing unit setting section configuring the settings of each of the processing units for the next processing operation based on the paper information of the memory each time the processing operation of each of the processing units is completed, wherein the paper sheet processing apparatus is a paper stack supplying apparatus arranged between a paper stacking apparatus and a bookbinding apparatus which has at least one clamper so as to supply a paper stack received from the paper stacking apparatus to the at least one clamper, and wherein the processing units are a jogger and a press unit which is arranged adjacently downstream of the jogger.

* * * * *